US005330792A

United States Patent [19]

Johnson et al.

[11] Patent Number: 5,330,792

[45] Date of Patent: Jul. 19, 1994

[54] METHOD OF MAKING LUBRICATED METALLURGICAL POWDER COMPOSITION

[75] Inventors: James R. Johnson, River Falls; Mary L. Orfield, Menomonie; William J. Mueller, Colfax, all of Wis.

[73] Assignee: Hoeganaes Corporation, Riverton, N.J.

[21] Appl. No.: 975,823

[22] Filed: Nov. 13, 1992

[51] Int. Cl.[5] ..... B05D 7/00; B32B 15/02

[52] U.S. Cl. ..... 427/217; 427/216; 428/407; 428/470

[58] Field of Search ..... 427/216, 217; 428/403, 428/470

[56] References Cited

U.S. PATENT DOCUMENTS

| | | | |
|---|---|---|---|
| 4,020,236 | 4/1977 | Aonuma et al. | 428/457 |
| 4,076,861 | 2/1978 | Funukawa et al. | 427/132 |
| 4,975,333 | 12/1990 | Johnson et al. | 428/570 |

*Primary Examiner*—Asok Pal
*Assistant Examiner*—P. Achutamurthy
*Attorney, Agent, or Firm*—Woodcock Washburn Kurtz Mackiewicz & Norris

[57] ABSTRACT

A method is provided for incorporating lubricant and a sintering aid into a metallurgical powder composition of iron-based powders. A particulate iron-based powder is contacted and wetted with solution of a metal salt of a fatty acid in an organic solvent. The solvent is removed to provide iron-based particles having a coating of the metal salt. The resulting self-lubricated powder composition can be compacted and sintered to produce a compact having superior strength properties.

20 Claims, No Drawings

METHOD OF MAKING LUBRICATED METALLURGICAL POWDER COMPOSITION

FIELD OF THE INVENTION

The present invention relates to a method for making a metallurgical powder composition of the kind containing organic lubricant and sintering aids. More specifically, the method relates to the preparation of compositions of iron-based powders in which a metal salt of a fatty acid is bonded to the surfaces of the individual iron-based powders. The organic portion of the metal salt provides lubricity during compaction and the metal portion of the salt provides an alloying component for the iron and in particular functions as a sintering aid.

BACKGROUND OF THE INVENTION

The use of powder metallurgical techniques in the production of metal parts is well established. In such manufacturing, iron or steel powders are often mixed with one other alloying element, also in particulate form, followed by compaction and sintering. The presence of the alloying elements permits the attainment of strength and other mechanical properties in the sintered parts at levels that could not be reached with unalloyed iron or steel powders alone.

In one aspect of this alloying procedure, it is an aim to have additional metals adhered in some manner to the surface of the iron-based particles so that upon compaction and sintering, desired alloys form along the grain boundaries. One art-recognized technique for accomplishing this result is to coat the iron-based particles with a sticky substance and then apply a dusting of the alloying materials, in fine particulate form, to coat the iron-based particles. The coated iron-based particles can then be heated to produce diffusion-bonded alloy particles on the surface of the core particles. The final parts made from the compaction and sintering of such pretreated powders have been known to attain improved density and strength. However, the original application of the alloying metal to the surfaces of the individual iron particles is often not uniform.

In some practices, the iron-based particles are admixed with particles of the alloying material as well as with small amounts of an organic binder that is used to bind or "glue" the alloying powders to the iron-based particles. Such compositions are generally not subjected to a pretreatment in order to diffusion-bond the alloying particles to the surfaces of the underlying iron-based particles, but rather are used "as is" in the further compaction and sintering steps leading to the finished metal part. It is known, however, that some such organic binders have adversely affected the compressibility of the powder, thereby lowering the density of the pressed "green" part as well as that of the final sintered part.

Powder metallurgical compositions are also traditionally provided with a lubricant, such as a metal stearate, a paraffin, or a synthetic wax, in order to facilitate ejection of the compacted green component from the die. The friction forces which must be overcome in order to remove a compacted part from the die, which generally increase with the pressure used to compact the part, are measured as the "stripping" and "sliding" pressures. The lubricants generally reduce these pressures, but their presence can also adversely affect compressibility of the powder composition. Although the compressibility of iron-based powder compositions that contain particulate alloy materials can be increased by reducing the amount of lubricant used, the resulting decrease in lubricity can cause unacceptably large increases in the ejection forces, which can result in scoring of the die, loss of die life, and imperfections in the surface of the compacted part. A traditional method for combining a lubricant with a metallurgical powder is to combined the lubricant, generally in solid particulate form, with the metal powder itself.

SUMMARY OF THE INVENTION

The present invention provides a method of incorporating a combined lubricant and sintering aid into a powder metallurgical composition of iron-based powders. According to the method, the composition of iron-based powders is contacted with an organic-solvent based solution of a metal salt of a fatty acid. The iron powders and the solution are used in relative amounts so as to provide about 0.1–3.0 weight parts of the salt per 100 weight parts of the iron-based powders. After the powders have been sufficiently wetted by the solution, the solvent is removed to provide iron-based particles having a coating of the metal salt.

In preferred embodiments, the metal component of the salt is capable of forming an alloy with iron under the sintering conditions normally used in the powder metallurgical arts. Preferably the metal is copper, molybdenum, nickel, manganese or mixtures thereof. In other preferred embodiments, the fatty acid is a $C_{12}$–$C_{20}$ fatty acid, such as stearic acid. In most preferred embodiments, the metal salt is copper (II) stearate.

The present invention provides a method of intimately incorporating sintering aid alloying elements and lubricant into the powder composition in a manner that wets or coats the base iron powders in a substantially uniform manner. The resulting powder composition has enhanced lubrication properties upon compaction, particularly in the initial part of the pressing cycle, and enhanced finished metal part properties upon sintering. Accordingly, the composition can be formulated and used without the need for the separate addition of other organic binders or lubricants.

DETAILED DESCRIPTION OF THE PREFERRED EMBODIMENTS

Methods for preparing a metallurgical powder composition of the kind containing a lubricant are set forth herein. The lubricant is provided as a metal salt of a fatty acid, the metal preferably being capable of forming an alloy with iron under conventional sintering conditions. The methods of the invention provide a self-lubricated metallurgical powder which, upon compaction and sintering using conventional powder metallurgy techniques, produces parts with superior strength and density properties. The powder can be formulated without the need for the separate addition of other organic binders or lubricants. The metallurgical powder can be compacted and sintered using conventional powder metallurgy techniques.

The lubricant is introduced in the form of a metal salt of a fatty acid in solution in an organic solvent. The iron-based powder is then wetted with the solution in a manner that ensures intimate and homogeneous contact between the solution and the iron-based powders. The organic solvent is then removed to produce the final powder composition of iron-based particles having a coating of the metal salt.

The coating of metal salt of fatty acid serves two important functions. The fatty acid portion provides lubricity to the powder composition upon compaction, while the metal portion provides ultrafine metal particles that form desired alloys along the grain boundaries upon sintering. The fatty acid portion of the salt is preferably a $C_{12}$–$C_{20}$ fatty acid, more preferably stearic acid. The metal portion of the salt is preferably a metal that is capable of forming an alloy with iron under conventional sintering conditions, such as copper, nickel, manganese, molybdenum, or mixtures of these. The preferred metal salt is copper (II) stearate. It is further preferred that the copper (II) stearate be of relatively high purity, in essentially stoichiometric proportion, thereby providing a copper compound containing about 10–12 weight percent copper.

The amount of salt provided to the iron-based powders can be optimized for a particular application. The metal component acts as a sintering aid providing increased strength and is thus beneficial at levels sufficiently high to promote good alloy formation. The fatty acid component acts as an internal lubricant, but since the organic portion also occupies space, its presence can adversely affect compressibility. It has been determined that the preferred amount of the metal salt relative to the iron-based powders is about 0.1–3 weight parts of metal salt per 100 weight parts of the unlubricated powder. More preferably about 0.5–1 weight parts, and most preferably about 0.7–0.8 weight parts, of metal salt are provided for each 100 weight parts of the iron-based powder. These preferred weight ratios are particularly preferred when the iron particles have an average particle size in the range of about 70–100 microns.

The iron-based particles that are useful in the invention are any of the iron or iron-containing (including steel) particles that can be admixed with particles of other alloying materials for use in standard powder metallurgical methods. Examples of iron-based particles are particles of pure or substantially pure iron; particles of iron pre-alloyed with other elements (for example, steel-producing elements); and particles of iron to which such other elements have been diffusion-bonded. The particles of iron-based material useful in this invention can have a weight average particle size up to about 500 microns, but generally the particles will have a weight average particle size in the range of about 10–350 microns. Preferred are particles having a maximum average particle size of about 150 microns, and more preferred are particles having an average particle size in the range of about 70–100 microns.

The preferred iron-based particles for use in the invention are highly compressible powders of substantially pure iron; that is, iron containing not more than about 1.0% by weight, preferably no more than about 0.5% by weight, of normal impurities. Examples of such metallurgical grade pure iron powders are the ANCORSTEEL 1000 series of iron powders (e.g. 1000, 1000B, and 1000C) available from Hoeganaes Corporation, Riverton, N.J. As a particular example, ANCORSTEEL 1000B iron powder, which has a typical screen profile of about 21% by weight of the particles below a No. 325 sieve and about 12% by weight of the particles larger than a No. 100 sieve (trace amounts larger than No. 60 sieve) with the remainder between these two sizes. The ANCORSTEEL 1000B powder has an apparent density of from about 2.8 to about 3.0 g/cm$^3$ (typically about 2.92).

The pre-alloyed powders are particles of iron that have been pre-alloyed with one or more elements of the kind that are known in the metallurgical arts to enhance the strength, hardenability, electromagnetic properties, or other desirable properties of the final sintered product. The pre-alloyed particles can be made by methods well-known in the art, including making a melt of the iron and the element or elements with which it is to be pre-alloyed and then atomizing the melt, followed by cooling and solidification of the atomized droplets to form the powder.

The alloying materials that can be so combined with iron include, but are not limited to, elemental molybdenum, manganese, chromium, silicon, copper, nickel, tin, vanadium, columbium (niobium), metallurgical carbon (graphite), phosphorus, aluminum, sulfur, and combinations thereof. Other suitable alloying materials are binary alloys of copper with tin or phosphorus; ferroalloys of manganese, chromium, boron, phosphorus, or silicon; low-melting ternary and quaternary eutectics of carbon and two or three of iron, vanadium, manganese, chromium, and molybdenum; carbides of tungsten or silicon; silicon nitride; and sulfides of manganese or molybdenum.

An example of a pre-alloyed iron-based powder is iron pre-alloyed with molybdenum (Mo), a preferred version of which can be produced by atomizing a melt of substantially pure iron containing from about 0.5 to about 2.5 weight percent Mo. Such a powder is commercially available as Hoeganaes ANCORSTEEL 85HP steel powder, which contains 0.85 weight percent Mo, less than about 0.4 weight percent, in total, of such other materials as manganese, chromium, silicon, copper, nickel, or aluminum, and less than about 0.02 weight percent carbon.

The diffusion-bonded iron-based particles are particles of substantially pure iron that have a layer or coating of one or more other metals, such as steel-producing elements, diffused into their outer surfaces. One such commercially available powder is DISTALOY 4600A diffusion bonded powder from Hoeganaes Corporation, which contains 1.8% nickel, 0.55% molybdenum, and 1.6% copper. Other such alloy-coated iron particles can be prepared by the sol-coating method disclosed in U.S. Pat. No. 4,975,333 issued Dec. 4, 1990, to Johnson et al.

The fatty acid metal salt is coated onto the iron-based metal powder in the form of a solution in an organic solvent. The organic solvent is preferably volatile, substantially non-polar, and chemically inert to both the metal salt and the iron-based powder. A preferred solvent for use with copper salts is tetrahydrofuran (THF). Amines, preferably primary and secondary amines having 1–4 carbons in the hydrocarbon radical(s), are preferred for the other metal salts. The preferred amine solvent is diethylamine.

The coating process is conducted such that the iron-based powder is intimately contacted with the solution of the metal salt. The concentration of the solution of metal salt is not critical, but because of such factors as solvent cost, removal cost, and environmental concern, the amount of solvent (that is, the diluteness of the solution) should generally be no greater than that necessary to ensure that the amount of powder to be coated can be thoroughly wetted. Typically, the solution concentration is about 25–100 grams of metal salt per liter of solution. One method of applying the metal salt is to spray the metal salt solution onto an agitated bed of the iron-based powder with continued mixing until removal of the solvent. The process is preferably conducted by flowing an inert gas through the mixing vessel to facilitate evaporative removal of the solvent.

The density and strength of compacts made from iron-based metal powders lubricated with copper (II) stearate according to the present invention are illustrated in the following experimental results. As comparative controls, compacts were made from iron-based powders that had been conventionally lubricated with ACRAWAX, a known lubricant for powder metallurgical purposes, or with copper (II) stearate; in the case of each control, the lubricant was combined with the iron-based powders in the conventional manner, by simply admixing the lubricant, in dry particulate form, with the iron-based powder. The iron-based powder used in these experiments was Hoeganaes ANCORSTEEL 1000B.

The copper (II) stearate used in these experiments was prepared according to the following procedure: Potassium stearate was first prepared by dissolving 60 g KOH in 1 liter distilled water and heating the solution to boiling. Stearic acid, 70 g, was added and stirred until a jelly of potassium stearate formed. The mixture was allowed to stand for about 16 hours to separate the solid potassium stearate, which was thereafter blended with an equal part of methanol and filtered. This filtering operation was conducted two more times using 4 parts methanol to 1 part potassium stearate. The potassium stearate (about 3 grams) was then dissolved in 150 ml of distilled water. Another solution was prepared with about 1.2 g cupric sulfate in 50 ml distilled water. The two solutions were combined, producing a blue precipitate of copper (II) stearate. The precipitate was filtered and washed with distilled water.

The three lubricant additives were admixed with the iron powder at levels of 0.75% wt. based on the weight of the iron powder. The controls of Acrawax and dry particulate copper (II) stearate were admixed with the iron powder using a mortar and pestle. To demonstrate the present invention, copper (II) stearate was dissolved in THF to a concentration of about 60 grams of metal salt per liter of solvent. The iron powder was then wetted with this solution, in relative amounts to provide about 0.75 part metal salt per 100 parts of iron-based powder. The solvent was thereafter removed, leaving a dry flowable powder.

The samples of the invention and two controls were then admixed with 0.6% wt. graphite, based on the weight of the lubricant-containing iron powder. The powder samples were compacted at 25 tons per square inch (tsi) and sintered at 1,100° C. in a hydrogen atmosphere for 1 hour. The green density, sintered density, and transverse rupture strength (TRS) values for the compacts made from powders of the invention, as shown in Table 1, were greater than those of the two controls.

TABLE 1

| Lubricant | Green Density ($g/cm^3$) | Sintered Density ($g/cm^3$) | TRS (kpsi) |
|---|---|---|---|
| ACRAWAX[1] | 6.59 | 6.55 | 59 |
| Dry-blended Cu(II)St[1] | 6.57 | 6.54 | 64 |
| Solution Cu(II)St[1] | 6.70 | 6.68 | 66 |

[1]Average data of three test samples.

In a second comparative experiment, iron powders lubricated with ACRAWAX lubricant in the conventional manner were compared to iron powders lubricated with copper (II) stearate according to the present invention. The weight percent composition of the Acrawax lubricant powder sample was 98.65% iron powder (Ancorsteel 1000B), 0.6% graphite, and 0.75% Acrawax lubricant; the sample lubricated with copper (II) stearate was 98.65% iron powder (Ancorsteel 1000B), 0.6% graphite, and 0.75% (dry basis) copper (II) stearate (added as a THF-based solution coating to the iron powder as described above). The powders were compacted at 50 tsi and sintered at 1,120° C. for 30 minutes in dissociated ammonia. The green density, sintered density, TRS, hardness, and stripping and sliding pressures were measured as shown in Table 2. The compacts made from the powder lubricated with copper (II) stearate according to the present invention showed improved strength at the increased compaction pressure while maintaining desired lubrication characteristics.

TABLE 2

| Lubricant | Green Density ($g/cm^3$) | Sintered Density ($g/cm^3$) | TRS (kpsi) | Hardness ($R_b$) | Strip (psi) | Slide (psi) |
|---|---|---|---|---|---|---|
| ACRAWAX | 7.01 | 7.12 | 100 | 50.3 | 4,245 | 2,115 |
| Solution Cu(II)St | 7.00 | 7.16 | 116 | 57.8 | 4,200 | 1,899 |

What is claimed is:

1. A method of producing a lubricated iron-based metallurgical powder composition, comprising:

(a) providing a solution of a metal salt of a fatty acid in an organic solvent, said metal being capable of forming an alloy with iron;

(b) wetting a metallurgical powder composition comprising iron-based particles having a weight average particle size of from about 10–350 microns with said solution in an amount to provide about 0.1–3 weight parts of metal salt to about 100 weight parts of the iron-based particles; and (c) removing the solvent to provide iron-based particles having a coating of the metal salt.

2. The method of claim 1 wherein said metal is copper, molybdenum, nickel, manganese, or mixtures of these.

3. The method of claim 2 wherein the fatty acid is a $C_{12}$–$C_{20}$ acid.

4. The method of claim 3 wherein the solvent comprises tetrahydrofuran or diethylamine.

5. The method of claim 3 wherein the metal salt solution is used in an amount to provide about 0.5–1 weight part of metal salt to about 100 weight parts of the iron-based particles.

6. The method of claim 3 wherein the metal comprises copper.

7. The method of claim 5 wherein the metal comprises copper.

8. The method of claim 5 wherein the metal salt is copper (II) stearate.

9. The method of claim 8 wherein the solvent comprises tetrahydrofuran.

10. The method of claim 8 wherein the metal salt solution is used in an amount to provide about 0.7–0.8 weight part of metal salt to about 100 weight parts of the iron-based particles.

11. A lubricated iron-based powder composition produced by the method of claim 1.

12. A lubricated iron-based powder composition produced by the method of claim 3.

13. A lubricated iron-based powder composition produced by the method of claim 8.

14. A method of producing a lubricated iron-based metallurgical powder composition consisting essentially of:

(a) providing a solution of a metal salt of a fatty acid in an organic solvent, said metal being capable of forming an alloy with iron and wherein said metal is selected from the group consisting of copper, molybdenum, nickel, manganese, and mixtures of these;

(b) wetting a metallurgical powder composition consisting essentially of iron-based particles having a weight average particle size of from about 10–350 microns with said solution in an amount to provide about 0.1–3 weight parts of metal salt to about 100 weight parts of the iron-based particles; and (c) removing the solvent to provide iron-based particles having a coating of the metal salt.

15. The method of claim 14 wherein the fatty acid is a $C_{12}$–$C_{20}$ acid.

16. The method of claim 15 wherein the solvent comprises tetrahydrofuran or diethylamine.

17. The method of claim 15 wherein the metal salt solution is used in an amount to provide about 0.5–1 weight part of metal salt to about 100 weight parts of the iron-based particles.

18. The method of claim 17 wherein the metal is copper.

19. The method of claim 15 wherein said iron-based particles comprise iron particles containing less than about 1% weight normal impurities.

20. The method of claim 3 wherein said iron-based particles comprise iron particles containing less than about 1% weight normal impurities.

* * * * *